US011364430B2

(12) United States Patent
Kogler et al.

(10) Patent No.: US 11,364,430 B2
(45) Date of Patent: Jun. 21, 2022

(54) CROSS-COUNTRY SKIING KIT WITH A CROSS-COUNTRY SKI BINDING AND WITH A CROSS-COUNTRY SKI BOOT

(71) Applicant: FISCHER SPORTS GMBH, Ried/Innkreis (AT)

(72) Inventors: Hannes Kogler, Ried/Innkreis (AT); Nicolas Fellin, Ried/Innkreis (AT)

(73) Assignee: FISCHER SPORTS GMBH, Ried/Innkreis (AT)

( * ) Notice: Subject to any disclaimer, the term of this patent is extended or adjusted under 35 U.S.C. 154(b) by 460 days.

(21) Appl. No.: 16/467,810

(22) PCT Filed: Dec. 19, 2017

(86) PCT No.: PCT/AT2017/060334
§ 371 (c)(1),
(2) Date: Jun. 7, 2019

(87) PCT Pub. No.: WO2018/112488
PCT Pub. Date: Jun. 28, 2018

(65) Prior Publication Data

US 2021/0362034 A1 Nov. 25, 2021

(30) Foreign Application Priority Data

Dec. 19, 2016 (AT) ..... A 51148/2016

(51) Int. Cl.
*A63C 9/20* (2012.01)
*A63C 9/00* (2012.01)
(Continued)

(52) U.S. Cl.
CPC ..... *A63C 9/20* (2013.01); *A63C 9/003* (2013.01); *A63C 9/086* (2013.01); *A43B 5/04* (2013.01)

(58) Field of Classification Search
CPC ..... A63C 9/10; A63C 9/003
See application file for complete search history.

(56) References Cited

U.S. PATENT DOCUMENTS 5,806,874 A * 9/1998 Sedlmair ..... A63C 5/07 280/602
2007/0138765 A1* 6/2007 Miette ..... A63C 5/02 280/615
(Continued)

FOREIGN PATENT DOCUMENTS

DE 3113941 A1 10/1982
DE 3838586 A1 6/1989
(Continued)

OTHER PUBLICATIONS

ISA European Patent Office, International Search Report Issued in Application No. PCT/AT2017/060334, dated Mar. 7, 2018, WIPO, 4 pages.

*Primary Examiner* — Brian L Swenson
(74) *Attorney, Agent, or Firm* — McCoy Russell LLP

(57) ABSTRACT

A cross-country skiing kit with a cross-country ski binding and with a cross-country ski boot, wherein the crosscountry ski binding, for articulated connection of a cross-country ski boot to a cross-country ski, is provided with a substantially unyielding binding main body which has a stand surface for a sole of the cross-country ski boot, with a holder device which has a seat for pivotable arrangement of the cross-country ski boot about a pivot axis extending in the transverse direction of the binding main body, with an elastically deformable resetting element for resetting the cross-country ski boot from an upwardly pivoted position in the direction of the stand surface of the binding main body, wherein at least one substantially unyielding elevation is provided on the stand surface of the binding main body, to the rear of the pivot axis in the longitudinal direction of the binding main
(Continued)

body, with which elevation the sole of the cross-country ski boot in its unloaded state is arranged at a distance from the stand surface of the binding main body.

15 Claims, 2 Drawing Sheets

(51) Int. Cl.
*A63C 9/086* (2012.01)
*A43B 5/04* (2006.01)

(56) References Cited

U.S. PATENT DOCUMENTS

2010/0314854 A1* 12/2010 Girard ..... A63C 9/003 280/607
2013/0300088 A1* 11/2013 Wollo ..... A63C 9/086 280/615
2014/0021696 A1* 1/2014 Soldan ..... A63C 9/086 280/625
2014/0091555 A1* 4/2014 Korich ..... A63C 9/005 280/607
2014/0110919 A1* 4/2014 Convert ..... A63C 9/08528 280/615
2014/0150300 A1 6/2014 Berthet et al.
2017/0196298 A1* 7/2017 Krumbeck ..... A63C 9/10

FOREIGN PATENT DOCUMENTS

DE 3915946 A1 12/1989
DE 102004018296 A1 2/2005
DE 102006041840 A1 2/2008
WO 9944700 A1 9/1999

* cited by examiner

CROSS-COUNTRY SKIING KIT WITH A CROSS-COUNTRY SKI BINDING AND WITH A CROSS-COUNTRY SKI BOOT

CROSS-REFERENCE TO RELATED APPLICATIONS

The present application is a U.S. National Phase of International Patent Application Serial No. PCT/AT2017/060334 entitled "CROSS-COUNTRY SKIING KIT WITH A CROSS-COUNTRY SKI BINDING AND WITH A CROSS-COUNTRY SKI BOOT," filed on Dec. 19, 2017. International Patent Application Serial No. PCT/AT2017/060334 claims priority to Austrian Patent Application No. A 51148/2016, filed on Dec. 19, 2016. The entire contents of each of the above-cited applications are hereby incorporated by reference for all purposes.

TECHNICAL FIELD

The invention relates to a cross-country skiing kit with a cross-country ski binding and with a cross-country ski boot, wherein, for an articulated connection of a cross-country ski boot to a cross-country ski, the cross-country ski binding comprises:

an essentially unyielding binding base body, which comprises a standing surface for a sole of the cross-country ski boot, a holding device, which comprises a receptacle for pivotable arrangement of the cross-country ski boot about a pivot axis extending in a transverse direction of the binding base body, an elastically deformable resetting element for resetting the cross-country ski boot from an upwardly pivoted position in the direction of the standing surface of the binding base body.

BACKGROUND

These types of cross-country ski bindings have been known for a long time in the prior art. During execution of the skating step, forward movement is achieved via alternating, lateral push-offs with the cross-country skis. Due to the arrangement of the elastic resetting element, also designated as a flexor, the lifting of the heel area of the cross-country ski boot is counteracted. After the push-off, the cross-country ski is lifted in order to bring the cross-country ski back into the glide direction. During the lifting, the cross-country ski loses contact with the snow surface, for which reason the cross-country ski may oscillate for a short time in the air. If this oscillating deflection is too large, then undesired contact of the ski blade and/or the ski end with the snow surface may occur, by which means the forward movement is interrupted or braked. To limit the oscillating movement between the ski boot and the cross-country ski, it was proposed in EP 1 005 387 B1 to apply another elastically deformable flexor behind the pivot axis of the cross-country ski binding in addition to the flexor on the front side of the boot. The flexors are hereby formed by exchangeable gum or rubber shaped parts. This type of cross-country ski binding comprising this type of counter-flexor is known, for example, from DE 102006041840 A1.

The known embodiment with rubber flexors in front of and behind the pivot axis of the cross-country binding has, however, a complex construction, due to which the costs are increased for manufacturing the cross-country binding. In addition, the rear flexor in particular tends toward material fatigue, due to which the function of the cross-country binding is impaired. Therefore, a regular exchange of the rear flexor is necessary in the prior art.

A cross-country binding of this type is also known from DE 3838586 A1. In this case, an elastic element is provided, which is inserted between the bottom of the groove in the sole and the upper side of the ski. The thickness of the material is hereby selected in such a way that it is compressible when the boot rolls flat on the ski.

A cross-country binding for pivotable connection of a cross-country boot to a cross-country ski is known from DE 3915946 A1. In addition, a raised section is shown in the area of the toe section of the standing surface, wherein, in the front end region, the sole has a level in the toe section adapted to the increase of the standing surface.

SUMMARY

The object of the invention consists in alleviating or avoiding the disadvantages of the prior art. Therefore, the invention has the goal of creating a cross-country ski binding of the type listed at the outset, with which the oscillating movement of the cross-country ski after the push-off is limited or prevented in constructively simple and reliable ways.

This problem is solved by a cross-country ski binding and a cross-country ski boot in which the cross-country ski binding includes an articulated connection of a cross-country ski boot to a cross country ski; an essentially unyielding base body with a standing surface for a sole fo the cross-country ski boot; a holding device including a receptacle for pivotable arrangement of a pivot pin of the cross-country ski boot about a pivot axis extending in the transverse direction of the binding base body; and an elastically deformable reset element for resetting the cross-country ski boot from an upwardly pivoted position in the direction of the standing surface of the binding base body. In some aspects, the cross-country ski boot in the unloaded state approaches at most an angle other than zero to the standing surface of the binding base body due to elevation.

According to the invention, at least one essentially unyielding elevation is provided behind the pivot axis on the standing surface of the binding base body, in the longitudinal direction of the binding base body, with which elevation the sole of the cross-country ski boot is arranged in its unloaded state at a distance from the standing surface of the binding base body.

In the cross-country ski binding according to the invention, the elevation on the standing surface of the binding base body interacts with the reset element to control the position of the cross-county ski boot relative to the binding base body during the execution of the cross-country skating step. The elastically deformable reset element ("flexor") is arranged in front of the receptacle of the holding device, when viewed in the longitudinal direction of the binding base body, to guide the cross-country ski boot back in the direction of the standing surface during the lifting of the cross-country ski at the conclusion of the push-off process. Due to the pivoting of the cross-country ski boot forward into the upwardly pivoted position, the reset element is elastically deformed, which is therefore manufactured from a corresponding soft material, in particular a rubber material. The reset element is preferably arranged detachably on the cross-country ski binding. Upon lifting the cross-country ski, the energy stored in the reset element is released, so that the cross-country ski and the cross-country ski boot approach each other. Thus, an oscillating movement of the cross-country ski relative to the cross-country ski boot may be induced. Advantageously, the scope of the oscillating movement is limited by the elevation on the standing surface of the binding base body. Due to the elevation, the cross-country ski boot may at most approach an angle other than zero to the standing surface of the binding base body in the unloaded state, i.e., before the weight transfer to the heel area of the cross-country ski boot. Accordingly, it may be prevented that the sole of the cross-country ski boot in the unloaded state is completely applied on the standing surface of the binding base body. Depending on the position and height of the elevation, the maximum angle of the oscillating movement of the cross-country ski is correspondingly reduced with respect to the cross-country ski boot. To introduce the next cross-country skating step, the cross-country ski is placed on the ground. By weight transfer to the heel region of the cross-country ski boot, the sole of the cross-country ski boot is pressed against the elevation on the standing surface. Thus, an elastic deformation of the sole of the cross-country ski boot is induced in the area of the elevation on the binding base body so that the sole of the cross-country ski boot is placed completely on the standing surface of the binding base body against the resistance due to the elevation. From this position, an effective push-off movement may be introduced, wherein the sole material of the cross-country ski boot is elastically expanded in the area of the elevation. The elevation on the binding base body is designed as essentially unyielding or rigid with respect to the pressure loads occurring during the complete contact of the sole of the cross-country ski boot on the standing surface. Thus, the elevation is subjected during use to at most minor elastic deformations which are negligible for the function of the cross-country ski binding. This embodiment is constructively substantially simpler than the prior art described according to EP 1 005 387 B1, in which the arrangement of the rear flexor drives the material costs much higher and additionally hampers the manufacturing of the cross-country ski binding. Furthermore, the invention includes the advantage that fatigue of the rear flexor may not occur. Thus, the function of the cross-country ski binding is guaranteed without limitations over longer usage periods. For these reasons, the rear flexor may be omitted, whose advantages primarily lie in the exchangeability and adjustability of the reset force.

According to one particularly preferred embodiment, the elevation on the standing surface is formed as one piece with the binding base body. Accordingly, the elevation in this embodiment is formed from the same material as the standing surface of the binding base body. The elevation is integrated into the binding base body so that the standing surface is continuously continued into the elevation. Advantageously, a particularly simple, cost-effective manufacturing of the cross-country binding is thus enabled. In addition, the stability of the cross-country ski binding is not impaired by the design of the elevation. It is particularly preferred if the cross-country ski binding with the elevation on the standing surface is formed as a single-component injection molded part. Thus, the standing surface and the elevation may be manufactured in a single injection molding step. The cross-country ski binding may naturally be provided with additional components.

In another preferred embodiment, the elevation is provided as an insertion part on the standing surface of the cross-country ski binding. In this embodiment, the binding base body is formed as (at least) two parts. The binding base body may have a receptacle opening for the insertion part which projects upwards past the standing surface of the binding base body to form the elevation.

For the purposes of this disclosure, positional and directional indications, like "above", "below", "front", "rear", etc. relate to the intended usage of the cross-country ski binding on the cross-country ski in its normal, horizontal position, wherein "front" means closer to the ski tip and "rear" means closer to the ski end.

To guarantee the stiffness of the elevation with respect to the vertical forces occurring during the execution of the cross-country skating step, it is favorable if the elevation on the standing surface of the binding base body is manufactured from a hard plastic material, in particular from acrylonitrile butadiene styrene copolymers (ABS), polyamide, preferably fiber reinforced polyamide, or from polyoxymethylene (POM) or from a metal, in particular from aluminum. The listed materials are suited in particular for a one-piece embodiment of the cross-country ski binding, in particular in the form of an injection molded part.

For reasons of stability, it is advantageous if the elevation is provided on a lateral edge region of the standing surface of the binding base body. By arranging the elevation on one of the longitudinal edges of the binding base body, an eccentric load transfer is carried out between the sole of the cross-country ski boot and the elevation on the binding base body.

To increase the torsional stability of the binding base body, it is favorable if in each case an elevation is provided on the opposite lateral edge region of the standing surface of the binding base body. Advantageously, the sole of the cross-country ski boot is supported on both sides by the elevations on the longitudinal edges of the binding base body, when the cross-country boot is pivoted downward in the direction of the standing surface.

According to one particularly preferred embodiment, the elevation on the standing surface has a front area ascending in the longitudinal direction of the binding base body, a rear area descending in the longitudinal direction of the binding base body, and an apex area between the front area and the rear area. Due to this embodiment, the support of the sole of the cross-country ski boot by the elevation increases when the sole is lowered onto the standing surface of the binding base body under elastic deformation by the elevation on the standing surface. The elevation comprises a maximum height, i.e., vertical extension, at the apex area with respect to the adjacent sections of the standing surface.

With respect to the operative conditions, the elevation is preferably arranged under a toe region of the cross-country ski boot. The elevation is preferably arranged adjacent to the pivot axis of the holding device. To clamp the cross-country ski boot in the unloaded state, i.e., before the weight transfer of the skier to the heel area of the cross-country ski boot, between the elastically deformable reset element and the elevation on the standing surface, it is particularly favorable if the apex area is spaced in a longitudinal distance of 3 mm to 9 mm, in particular from 5 mm to 7 mm, preferably essentially 6 mm from the pivot axis of the holding device.

According to one preferred embodiment, the elevation on the standing surface is curved in the longitudinal section, arcshaped, in particular circular arc shaped. Thus, the path of the counter force exerted by the elevation on the sole may be adapted in an advantageous way.

According to another preferred embodiment, the elevation comprises an essentially flat contact surface in the front area, which is arranged at an obtuse angle to a contacting front section of the standing surface of the binding base body, wherein the elevation preferably comprises an essentially flat flank in the rear area which is arranged at an obtuse angle to a contacting rear section of the standing surface of the binding base body. The flat standing surface in the front area of the elevation is preferably steeper than the flank in the rear area of the elevation, which thus declines more shallowly to the contacting section of the standing surface.

To counter sufficient resistance to the elastic deformation of the sole upon pressing onto the standing surface by the elevation, it is favorable if the elevation comprises a maximum extension perpendicular to the primary plane of the standing surface of the binding base body of 0.5 mm to 2.5 mm, preferably 1 mm to 2 mm, in particular essentially 1.5 mm.

The previously described cross-country binding may be used with a conventional cross-country ski boot, which comprises a connecting element in the toe region, in particular in the form of a pivot pin which is connectable to the receptacle of the holding device of the cross-country ski binding. The sole of the cross-country ski boot comprises a contact area for pressing onto the elevation of the cross-country ski binding. The sole is elastically deformable at least in the contact area by the elevation on the standing surface, when the skier carries out a weight transfer to the heel area of the cross-country ski binding so that the sole of the cross-country ski boot is brought into an essentially horizontal position on the standing surface under elastic deformation of the contract area by the elevation. Therefore, the elastic deformability of the sole of the cross-country ski boot, at least in the contact area, is multiple times, in particular many times higher than that of the elevation on the standing surface, which, in comparison to the sole of the cross-country boot, is therefore essentially unyielding, i.e., is not elastically deformable by the weight of the skier.

As per convention, the cross-country ski binding is mounted during use on a cross-country ski, which comprises a distinct longitudinal axis which corresponds to the longitudinal direction of the binding base body.

BRIEF DESCRIPTION OF THE FIGURES

The invention is subsequently explained in greater detail by way of preferred exemplary embodiments; however, it is not limited to them.

DETAILED DESCRIPTION

Figure 1:
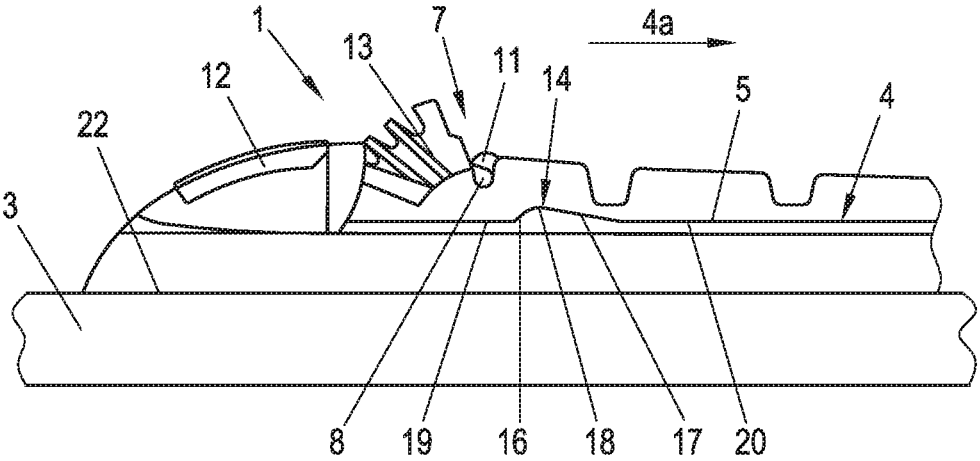
FIG. 1 schematically shows a section of a cross-country ski with a cross-country ski binding according to the invention, which comprises a yielding reset element in front of the pivot axis and an unyielding elevation behind the pivot axis for holding up the cross-country ski boot (see FIG. 2).

A cross-country ski binding 1 for pivotable connection of a cross-country ski boot 2 to a cross-country ski 3 is shown in FIG. 1. Such cross-country ski kits have been known in the prior art for a long time, such that in the following only the features essential for the invention shall be described.

Cross-country ski binding 1 comprises a binding base body 4, formed from an essentially unyielding (i.e., non-elastic) material, which comprises a guide rail 21 in a central area. On the upper side, binding base body 4 comprises a standing surface 5 for placing a sole 6 of the cross-country ski boot 2 (see FIG. 2). On the underside, binding base body 4 comprises an essential flat ski standing surface 22, which is mounted in the embodiment shown directly on cross-country ski 3. However, additional, in particular plate-shaped mounting elements (not shown) may be provided between binding base body 4 and cross-country ski 3. In this case, ski standing surface 22 is connected indirectly to cross-country ski 3. In addition, cross-country ski binding 1, as likewise known for a long time, comprises a holding device 7 for detachable connection to cross-country ski boot 2. Holding device 7 comprises a receptacle 8 for pivotable arrangement of a pivot pin 9 of cross-country ski boot 2 about a pivot axis 10 (see FIG. 3), which extends in the transverse direction of binding base body 4 (or in the transverse direction of cross-country ski 3). For this purpose, holding device 7 comprises two displaceably or pivotably mounted hooks 11, which hold pivot pin 9 on receptacle 8 in the connected state. To release cross-country ski boot 2, holding device 7 additionally comprises a handle 12, which is formed by a rotating handle in the embodiment shown. By rotating the rotating handle, hooks 11 may be pivoted between a release and a holding position.

In addition, cross-country ski binding 1 comprises a reset element 13, which is designated multiple times in the prior art as a flexor. Reset element 13 comprises an elastically deformable (rubber) material to press cross-country ski boot 2 from an upwardly pivoted position after the push-off (not shown) in the direction of standing surface 5 of binding base body 4.

In the embodiment shown, cross-country ski binding 1 additionally comprises at least one elevation 14, which projects from standing surface 5 of binding base body 4 and is located behind pivot axis 10 of holding device 7 when viewed in longitudinal direction 4*a* of binding base body 4 from its front end to its rear end. In the embodiment shown, elevation 14 is arranged completely behind pivot axis 10, when viewed in longitudinal direction 4*a*; however, it may suffice if elevation 14 starts in front of pivot axis 10 but reaches the maximum height (vertical extension) behind pivot axis 10.

In contrast to reset element 13, elevation 14 is designed as essentially unyielding so that the underside of sole 6 of cross-country ski boot 2 is arranged, in the unloaded state before a weight transfer to a heel area of cross-country ski boot 2, at a distance from standing surface 5 of binding base body 4. When loading cross-country ski binding 1 with the weight of the skier, sole 6 of cross-country ski boot 2 is brought into full surface contact (aside from the interstices of the sole profile naturally) with standing surface 5 of binding base body 4 under elastic deformation in the area of elevation 14. This embodiment facilitates a reduction of the oscillating movement of cross-country ski 3 with respect to cross-country ski boot 2 when lifting cross-country ski 3, in that an angle a of, for example, 8° to 13° is not exceeded between the underside of the sole of cross-country ski boot 2 and standing surface 5. This is achieved in that sole 6 is mechanically clamped between elevation 14 (for example, lens shaped in the top view) and pivot axis 10. Sole 6 is slightly elevated by elevation 14 so that sole 6 is pressed in its front area against elastically deformable reset element 13, by which means an elastic reaction force is generated in reset element 13.

In the embodiment shown, elevation 14 is formed as one piece with binding base body 4. Binding base body 4 is hereby preferably formed from a hard plastic material, in particular from acrylonitrile butadiene styrene copolymers (ABS), polyamide, preferably fiber reinforced polyamide, or from polyoxymethylene (POM) or from a metal, in particular from aluminum.

Figure 3:
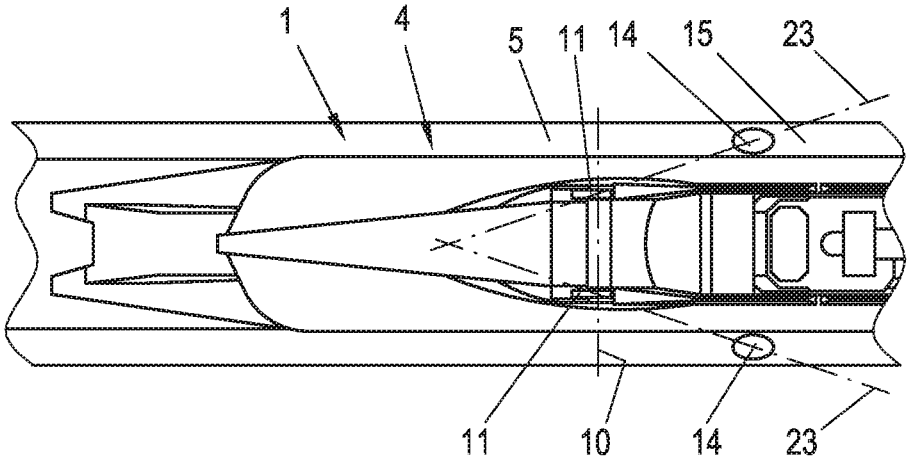
FIG. 3 shows a top view on the cross-country ski binding according to FIGS. 1 and 2.

As is clear in the embodiment shown in FIG. 3, two identical elevations 14 are provided which are arranged on opposite lateral edge regions 15 of binding base body 4. Due to this double-sided arrangement of elevations 14, an increased torsional stability is achieved, as the forces are built up on both sides, namely in the direction of dashed-dotted lines 23.

Figure 2:
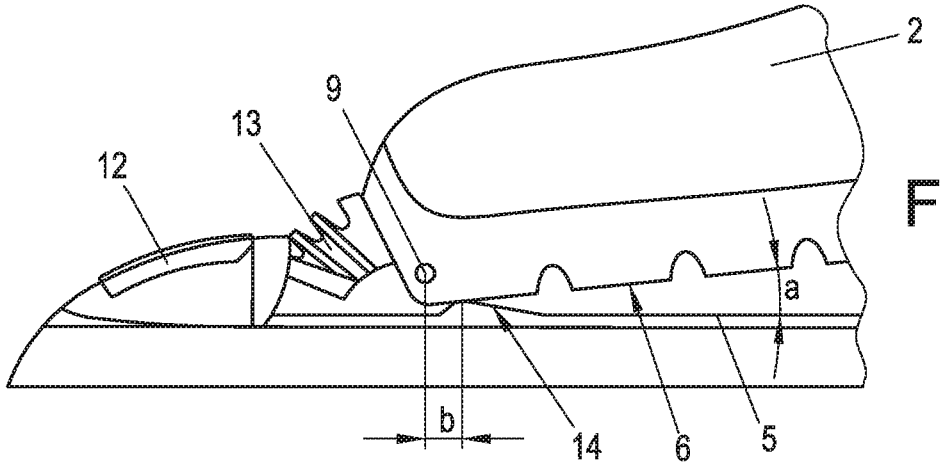
FIG. 2 shows the cross-country ski boot on the cross-country ski binding of FIG. 1 in the unloaded state shortly before the introduction of the gliding phase, wherein the cross-country ski boot is arranged by the elevation on the binding base body in a tilted position at a distance from the standing surface.

As is clear from FIGS. 1 and 2, elevation 14 on standing surface 5 comprises a front area 16 ascending in the longitudinal direction of binding base body 4, a rear area 17 descending toward the back in the longitudinal direction of binding base body 4, and an apex area 18 between front area 16 and rear area 17. Apex area 18 comprises the maximum vertical extension with respect to sections 19 and 20 of standing surface 5 contacting elevation 14.

Apex area 18 is preferably located in a longitudinal spacing b from pivot axis 10 of holding device 7 (see FIG. 2) of 3 mm to 9 mm, in particular from 5 mm to 7 mm, preferably essentially 6 mm. Elevation 14 hereby preferably comprises a maximum extension c perpendicular to the main plane of standing surface 5 of binding base body 4, i.e., a height of 0.5 mm to 2.5 mm, preferably from 1 mm to 2 mm, in particular essentially 1.5 mm (see FIG. 4). It follows that the height of elevation 14 is depicted as exaggerated in the drawings.

Elevation 14 may have different geometries, as are illustrated by way of figures FIGS. 1 to 5.

According to FIGS. 1 and 2, elevation 14 is essentially flat in front area 16, wherein front area 16 is arranged at an obtuse angle to a contacting front section 19 of standing surface 5 of binding base body 4. Rear area 17 of elevation 14 is likewise essentially flat, wherein rear area 17 is arranged at an obtuse angle to a contacting rear section 20 of standing surface 5 of binding base body 4. Front area 16 is steeper with respect to ski standing surface 22 than rear area 17 of elevation 14. Apex area 18 between front area 16 and rear area 17 is curved in an arc shape in the longitudinal cross section, i.e., in the cross section perpendicular to pivot axis 10.

Figure 4:
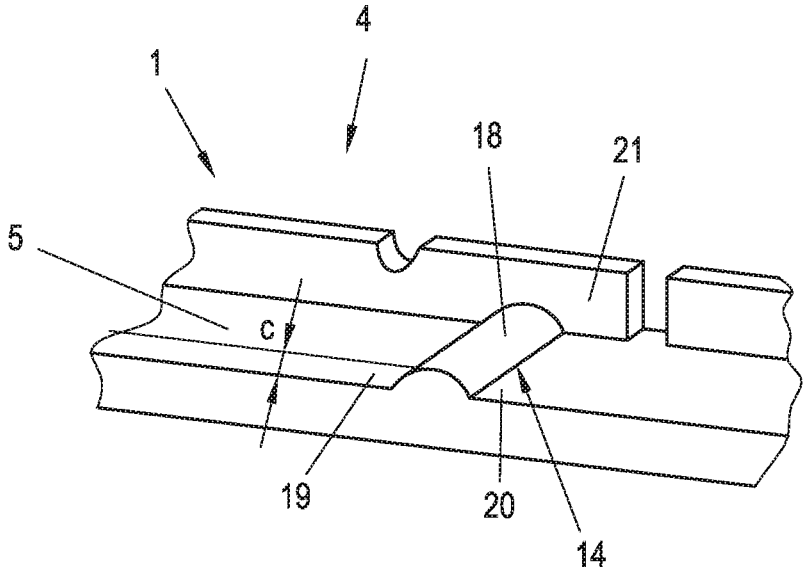
FIG. 4 shows a longitudinal edge of the cross-country ski binding in another embodiment according to the invention in which the elevation on the standing surface is formed as a segment of a cylinder.

According to FIG. 4, elevation 14 a standing surface 5 is curved in an arc shape, in particular a circular arc shape in the longitudinal cross section (i.e., in the cross section perpendicular to pivot axis 10). Thus, elevation 14 is formed as a segment of a cylinder.

Figure 5:
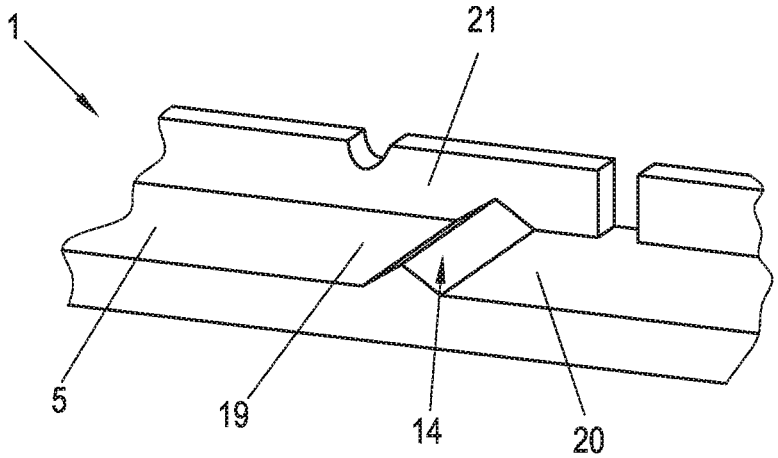
FIG. 5 shows a longitudinal edge of the cross-country ski binding in another embodiment according to the invention in which the elevation on the standing surface is formed as a type of pitched roof.

According to FIG. 5, front area 16 and rear area 17 are each formed as essentially flat, wherein front area 16 and rear area 17 are arranged in essentially the same obtuse angle to front section 19 of the standing surface or to rear section 20 of standing surface 5 on both sides of elevation 14.

The invention claimed is:

1. A cross-country skiing kit comprising a cross-country ski binding and a cross-country ski boot, wherein the cross-country ski binding comprises an articulated connection of the cross-country ski boot to a cross-country ski, the cross-country skiing kit comprising:

an unyielding binding base body, which comprises a standing surface for a sole of the cross-country ski boot, a holding device, which comprises a receptacle for pivotable arrangement of a pivot pin of the cross-country ski boot about a pivot axis extending in a transverse direction of the binding base body, an elastically deformable reset element for resetting the cross-country ski boot from an upwardly pivoted position in the direction of the standing surface of the binding base body, wherein the reset element is arranged on the cross-country ski binding, and at least one unyielding elevation on the standing surface of the binding base body behind the pivot axis in a longitudinal direction of the binding base body, wherein with the unyielding elevation, the sole of the cross-country ski boot is arranged in an unloaded state at a distance from the standing surface of the binding base body, wherein the cross-country ski boot in the unloaded state approaches an angle other than zero to the standing surface of the binding base body.

2. The cross country skiing kit according to claim 1, wherein the elevation is formed on the standing surface as one piece with the binding base body.

3. The cross country skiing kit according to claim 1, wherein the elevation on the standing surface of the binding base body is manufactured from a hard plastic material.

4. The cross country skiing kit according to claim 3, wherein the hard plastic material is acrylonitrile butadiene styrene copolymers (ABS), polyamide, p polyoxymethylene (POM) or metal.

5. The cross country skiing kit of claim 4, wherein the metal is aluminum.

6. The cross country skiing kit according to claim 1, wherein the elevation is provided on a first lateral edge region of the standing surface of the binding base body.

7. The cross country skiing kit according to claim 6, wherein a second elevation is provided on a second lateral edge region of the standing surface, wherein the second lateral edge region is opposite the first lateral edge region of the standing surface of the binding base body.

8. The cross country skiing kit according claim 1, wherein the elevation on the standing surface comprises a front area ascending in the longitudinal direction of the binding base body, a rear area descending in the longitudinal direction of the binding base body, and an apex area between the front area and the rear area.

9. The cross country skiing kit according to claim 8, wherein the apex area is spaced in a longitudinal distance of 3 mm to 9 mm apart from the pivot axis of the holding device.

10. The cross country skiing kit according to claim 8, wherein the elevation on the standing surface is curved in an arc shape, in the longitudinal cross section.

11. The cross country skiing kit according to claim 8, wherein the elevation comprises a flat contact surface in the front area, arranged at an obtuse angle to a contacting front section of the standing surface of the binding base body, wherein the elevation comprises a flat flank in the rear area arranged at an obtuse angle to a contacting rear section of the standing surface of the binding base body.

12. The cross country skiing kit according to claim 8, wherein the apex area is spaced in a longitudinal distance of 6 mm apart from the pivot axis of the holding device.

13. The cross country skiing kit according claim 1, wherein the elevation comprises a maximum extension perpendicular to the primary plane of the standing surface of the binding base body of 0.5 mm to 2.5 mm.

14. The cross country skiing kit according claim 1, wherein the cross-country ski binding is mounted on a cross-country ski.

15. The cross country skiing kit according claim 1, wherein the elevation comprises a maximum extension perpendicular to the primary plane of the standing surface of the binding base body of 1.5 mm.

* * * * *